United States Patent [19]

Dantzer-Sorensen et al.

[11] 4,446,597

[45] May 8, 1984

[54] HINGE DEVICE FOR INCLINED TILTING TYPE WINDOWS WITH EXTERNAL COVER RAILS

[75] Inventors: Bendt Dantzer-Sørensen, Holte, Denmark; Per B. Christensen, The Canary Islands, Spain

[73] Assignee: V. Kann Rasmussen Holding A/S, Søborg, Denmark

[21] Appl. No.: 390,972

[22] Filed: Jun. 22, 1982

[30] Foreign Application Priority Data

Jul. 3, 1981 [DK] Denmark ..... 2969/81

[51] Int. Cl.[3] ..... E05D 15/32

[52] U.S. Cl. ..... 16/364; 16/347; 16/368; 16/370

[58] Field of Search ..... 16/347, 364, 368, 370

[56] References Cited

U.S. PATENT DOCUMENTS 4,359,805 11/1982 Berneke ..... 16/347

4,366,597 1/1983 Rasmussen ..... 16/368

*Primary Examiner*—Fred Silverberg

*Attorney, Agent, or Firm*—Lane, Aitken & Kananen

[57] ABSTRACT

In a hinge device for inclined tiltable windows with external overlapping cover rails, the base plate of the main frame supports through a pair of pivotable links an intermediate member which is movable in a parallelogramlike—or pantographlike—manner and itself carries a pivot pin on which the sash base plate of the hinge device is journalled. The rotation of said base plate about the pivot pin is co-ordinated with the movement of the intermediate member by way of a coupling link that through pivot pins is connected with the sash base plate and the pivotable link adjacent the coupling link, respectively. The coupling link makes it possible in a simple and cheap manner to reliably controlling the hing parts during the full tilting of the sash in both directions.

1 Claim, 3 Drawing Figures

HINGE DEVICE FOR INCLINED TILTING TYPE WINDOWS WITH EXTERNAL COVER RAILS

BACKGROUND OF THE INVENTION

This invention relates to a hinge device for inclined tiltable windows with external upper and lower cover rails which are secured to the main frame of the window and to its sash, respectively, and in the closing position of the window overlap each other in the area of the tilting axis of the sash, said hinge device being of the known type comprising two base plates adapted to be secured to the main frame of the window and to its sash, respectively, and an intermediate member inserted between said base plates and with which the sash base plate is tiltably connected through a pivot pin, said intermediate member being connected through a pair of pivotable links in a parallelogramlike manner with the base plate of the main frame so as to cause the upper end portion of the cover rail of the window sash, during initial tilting thereof in the opening direction to be downwardly displaced along the underside of the lower end portion of the main frame cover rail to get clear thereof so as to allow further tilting or rotation of the sash, and means for coordinating the rotation of the sash base plate about the pivot pin in relation to the intermediate member with the parallelogramlike movement of this member in relation to the base plate of the main frame.

A hinge device of said kind is disclosed in the specification of Danish Patent Application No. 2904/79 (corresponding to e.g. U.S. Ser. No. 159,462 filed June 16, 1980, now U.S. Pat. No. 4,366,597), according to which the structure includes a guide pin which is responsible for the coordination of the mainly translatory displacement of the intermediate member and the tilting or rotation of the sash hinge part about the pivot pin. Said guide pin is usually fixed to the base plate of the sash part of the hinge and cooperates, on the one hand, with the concave side of an arc-shaped guide member on the base plate of the main frame hinge part and, on the other hand, with an opposite edge provided on one of the pivotable links associated with the intermediate member. A condition of a perfect function of such a structure is that the guide pin slides sufficiently easily between the guide member and the edge, as a clumsy closing of the window sash would otherwise cause the guide pin to get jammed, following which an increased force exerted on the sash might cause damage to the hinge. Moreover, it may be considered to constitute an undesired complication of the prior hinge device that the base plates of said two hinge parts must be provided with cooperating guide cams which become operative when said guide pin at the transition from the initial opening of the sash till its rotation about the pivot pin gets clear of the associated guide surfaces of the hinge part.

SUMMARY OF THE INVENTION

The hinge device according to the invention differs from the prior art design in that the co-ordination of both movements referred to above is ensured by means of a coupling link, the ends of which are pivotally connected with the sash base plate and the adjacent pivotable link between the intermediate member and the main frame base plate, resp., at points which in the closing position of the window are approximately in alignment with the pivot points of the pivotable links on the main frame base plate and their pivot points on the intermediate member, resp., and are further so located that their connecting line in said position and reckoned outwardly, or towards the outer surface of the window, converges to the connecting line of the pivot points of the adjacent pivotable link on the main frame base plate and the intermediate member, respectively, the pivot pin between the sash base plate and the intermediate member in the same position of the hinge device being at least approximately coaxial with the pivot point between said adjacent pivotable link and the main frame base plate.

In the above arrangement the said coupling link can co-ordinate the two movements during the full tilting of the sash from its closing position to its reversed or cleaning position, because an increasing proportion between the rotation about the pivot pin and the displacement of this pin during the opening of the sash is ensured by a correct dimensioning of the individual hinge elements and a correct positioning of the various pivot points. In other words, during the initial opening of the sash, the coupling link causes the pivot pin to be displaced relatively quickly (to eliminate the overlapping of the cover rails), while during the further movement the rate of displacement of the pivot is gradually reduced, and when the sash approaches its reversed position the pivot pin may be almost stationary. However, through the coupling link the position of the pivot pin will always be positively determined by the angular position of the sash, so as to allow the window to be reclosed as intended independently of the frictional conditions in the hinge device and without the need of additional arrangements to ensure the correct movement of the individual elements.

Moreover, it is essential to the use of the hinge device that the intended movement of the sash be obtained with a relatively short length of the pivotable links and the coupling link and, consequently, with correspondingly small extension of hinge perpendicular to the window plane. The reason is that it is generally desired to equip the main frame and sash of the window with inside rabbet or tightening strips which in the closing position of the window ensures wind-tightness as a supplement to the tightness provided by the external cover rails against penetrating water, thereby creating a continuous barrier beneath or behind the hinge. The extension of the hinge in the direction perpendicular to the window plane thus sets a lower limit in the same direction to the dimension of the side members of the main frame and the sash, and a reduction of said hinge extension so provides for obtaining a corresponding reduction of the cross-sectional height of the side members of the main frame and the sash, thereby entailing considerable savings as to material costs.

DETAILED DESCRIPTION OF THE PREFERRED EMBODIMENT

Figure 1:
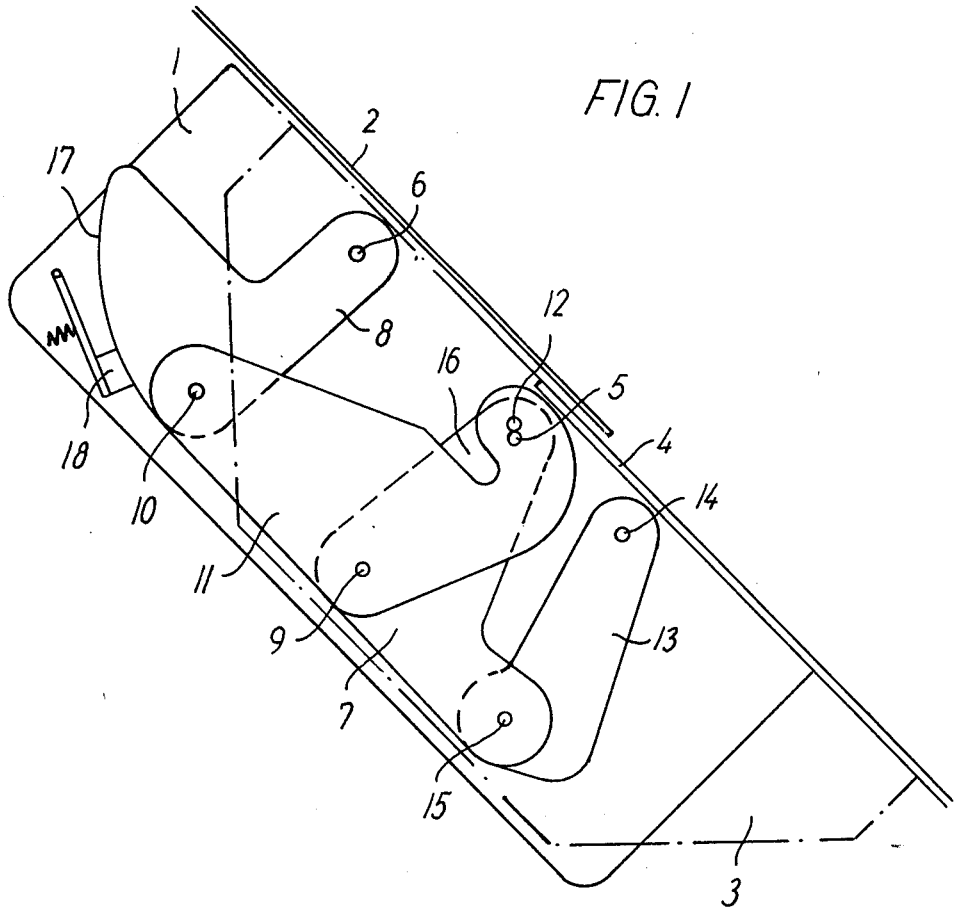
FIG. 1 illustrates a rather schematical view of a preferred embodiment of the hinge device according to the invention in the closing position of the window, and FIGS. 2 and 3 corresponding views with the sash tilted about 45° and more than 90°, resp., in its opening position.

The illustrated hinge comprises a base plate 1 secured to the central portion of a side member of the main frame of a window provided with an upper cover rail 2, and another base plate 3 arranged to be fastened to the corresponding sash side member with the lower cover rail 4, the top end portion of which in the closed position, FIG. 1, extends somewhat upwards beneath the lower end of the cover rail 2. As the sash base plate 3 is positioned above the drawing plane, it is only shown in dot-and-dash lines.

Figure 2:
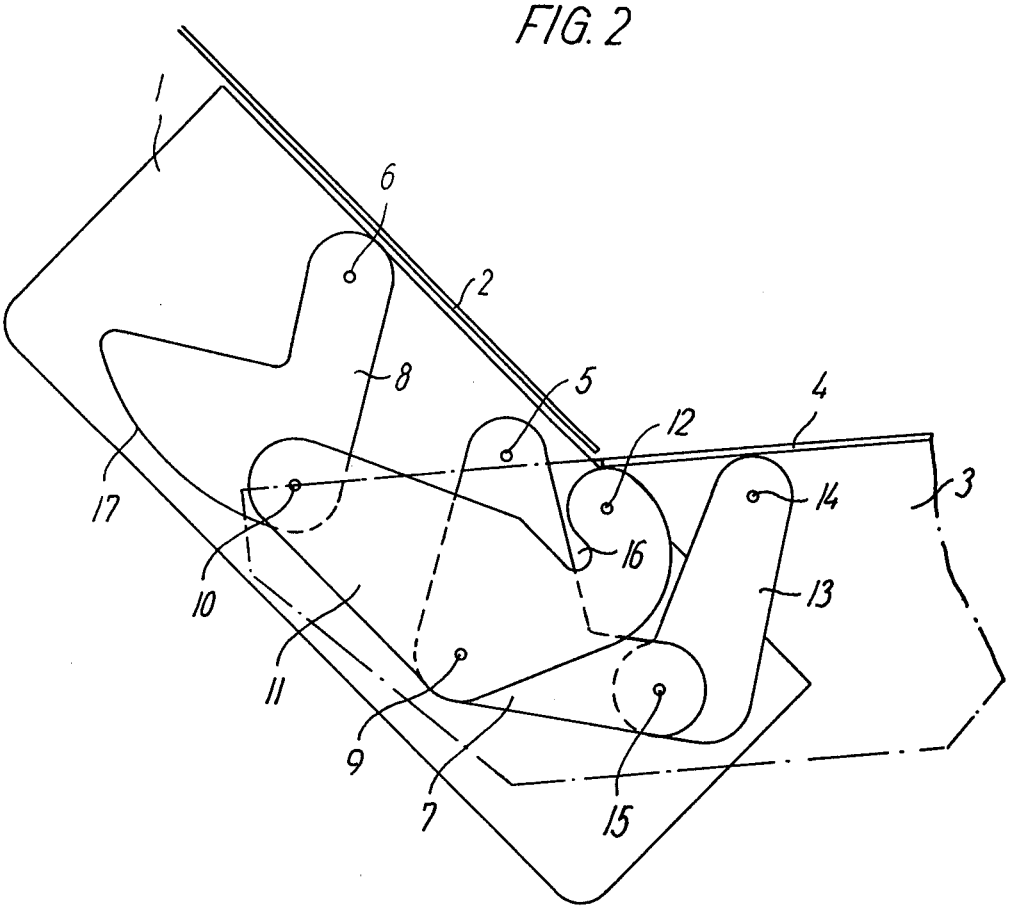
Figure 3:
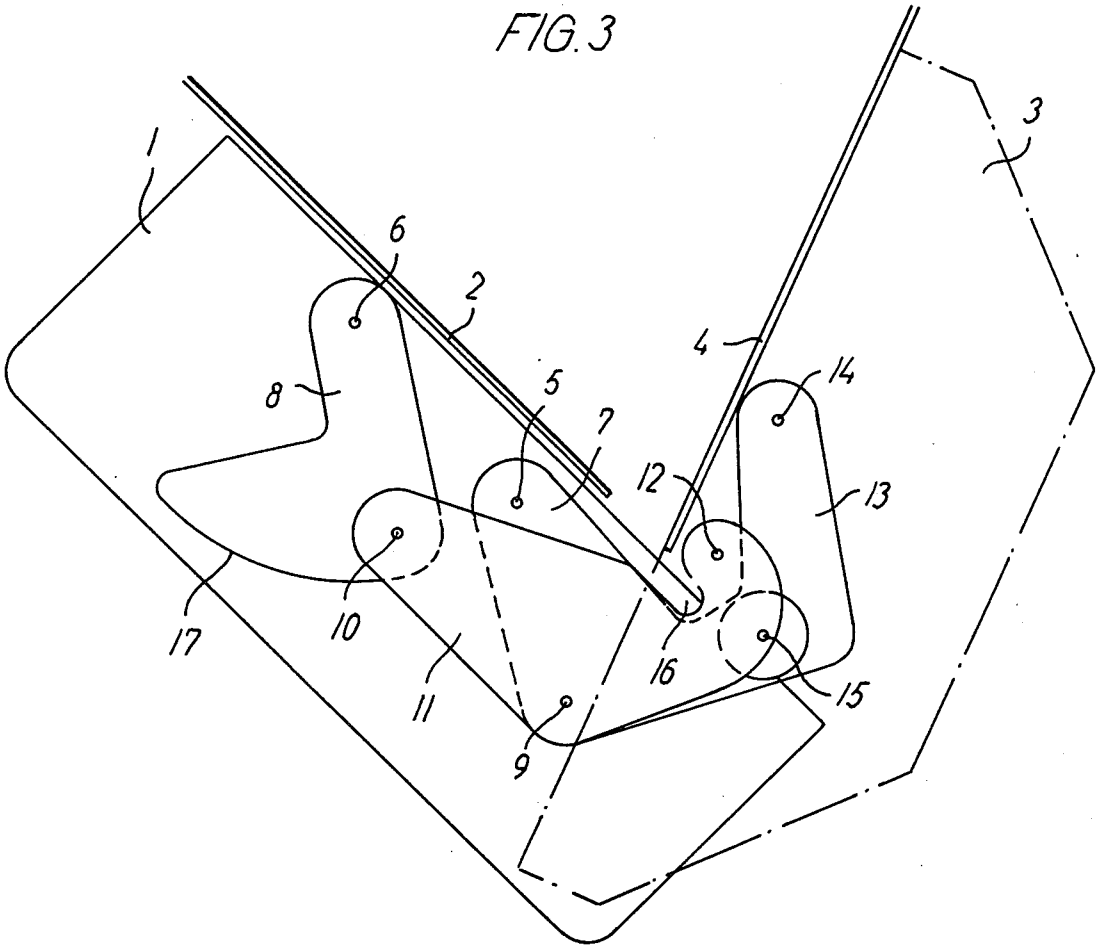

In the vicinity of its front edge the main frame base plate 1 carries two pivot pins 5 and 6 located opposite the overlapping area of the cover rails and at some distance thereabove, resp., said pins connecting a respective one of two pivotable links 7 and 8 with said base plate. Through a pair of additional pivot pins 9 and 10 these links support an intermediate member 11 which by the links is guided for a mainly translatory downward movement from the position in FIG. 1 via the position in FIG. 2 to the position in FIG. 3, said four pivot pins 5, 6, 9 and 10 being located at any rate approximately as corners in a parallelogram.

The intermediate member 11 is connected through a further pivot pin 12, which in the closed position, FIG. 1, is almost co-axial with the pin 5, and is connected with the sash base plate 3. The tilting or rotation of the intermediate member about the pivot pin 12 is being controlled by a link 13, wherein the link 13 is connected through pins 14 and 15 with the sash base plate 3 and a lateral lobe on the pivotable link 7, respectively. When in the closed position said pins 14 and 15 are approximately placed on the connecting lines of the pins 5 and 6 and the pins 9 and 10, resp., and as it appears from the drawing the distance between pins 5 and 14 is somewhat shorter than the distance between pins 9 and 15, so that the direction of the coupling link 13, represented by the connecting line of its pins 14 and 15, in the outward direction from the window converges relative to the direction of the pivotable link 7 represented by the connecting line of its pins 5 and 9.

When the window sash is moving away from its closed position the intermediate member is being translatorily displaced downwards so that its individual points as well as the pivot pin 12 follow circular arcs having the same radius as the length of said two pivotable links 7 and 8. This causes a simultaneous tilting and downward displacement of the central portion of the sash, thereby allowing the upper end portion of the sash cover rail 4 to get clear of the lower end portion of the main frame cover rail 2, see FIG. 2. Suppose the sash base plate 3 is tilted or rotated by constant angular rate, the rate of displacement of the pivot pin 12 will gradually decrease, and at the same time said pivot pin will approach the connecting line between the two pivot pins 14 and 15 of the coupling link 13, see FIG. 3. In this situation, a recess 16 in the intermediate member 11 will leave space for the overlapping portion of the cover rail 4.

If an enhanced friction is desired in the hinge device the pivotable link 8 may appropriately, as illustrated, comprise a lateral lobe presenting a circular arc-shaped edge 17 with its centre located in pivot pin 6 and cooperating with a spring-loaded brake shoe 18 only shown in FIG. 1.

We claim:

1. A hinge device for inclined tilting type windows having a stationary main frame and a tiltable sash with external cover rails on said main frame and said sash in overlapping relationship when the window is closed, comprising a first hinge part including a first base plate to be mounted on said main frame, a second hinge part including a second base plate to be mounted on said sash, an intermediate member connected to said first base plate by means of substantially parallel links, said links being connected through lower pivot pins to said intermediate member and through upper pivot pins to said first base plate, so as to be displaceable in a substantially translatory parallelogram-like movement relative to said first base plate, an upper pivot pin interconnecting said second base plate with said intermediate member and movable, by displacement of said intermediate member, between first and second positions in which it is located between the inner and outer surfaces of said main frame and spaced outwardly from its outer surface, respectively, and a coupling link having its ends pivotally connected by an upper pivot pin with said second base plate and by a lower pivot pin with an adjacent one of said parallel links, respectively, when the window is closed the upper pivot pins of the coupling link, the parallel links and the intermediate member are approximately in alignment and the lower pivot pins of the coupling link, the parallel links and the intermediate member are approximately in alignment, and are further so located that a line connecting the upper and lower pivot pins of the coupling link, when the window is closed, converges relative to a line connecting the upper and lower pivot pins of said adjacent pivotable link on said first base plate and said intermediate member, respectively, the upper pivot pin connecting said second base plate with said intermediate member being, in the same position of the hinge device, at least approximately coaxial with the upper pivot pin between said adjacent pivotable link and said first base plate.

* * * * *

UNITED STATES PATENT AND TRADEMARK OFFICE

CERTIFICATE OF CORRECTION

PATENT NO. : 4,446,597

DATED : May 8, 1984

INVENTOR(S) : BENDT DANTZER-SØRENSEN ET AL

It is certified that error appears in the above-identified patent and that said Letters Patent is hereby corrected as shown below:

Column 4, line 36, the following should be insert after "respectively", -- said upper and lower pivot pins being so located that, --;

Column 4, line 37, a comma (,) should be insert after "closed";

Column 4, line 42, "are further so located" should be deleted; and -- , further, -- should be inserted after "that"; and Column 4, line 44, ", when the window is closed" should be deleted.

Signed and Sealed this

*Eighteenth* Day of *September 1984*

[SEAL]

*Attest:*

GERALD J. MOSSINGHOFF

*Attesting Officer*

*Commissioner of Patents and Trademarks*